US005531411A

United States Patent [19]

Adams

[11] Patent Number: 5,531,411

[45] Date of Patent: Jul. 2, 1996

[54] MOUNTING CLIP FOR DECORATIVE LIGHTS

[75] Inventor: William E. Adams, Portersville, Pa.

[73] Assignee: Adams Mfg. Corp., Portersville, Pa.

[21] Appl. No.: 339,025

[22] Filed: Nov. 14, 1994

[51] Int. Cl.[6] ..... F21V 21/08; F21V 21/34

[52] U.S. Cl. ..... 248/65; 362/391; 362/396; 362/123; 439/419; 248/316.7; 248/309.1

[58] Field of Search ..... 439/419, 505, 439/506, 558, 575; 362/123, 396, 238, 226, 249, 251, 397, 250, 391, 392, 393; 248/314, 309.1, 309.2, 229, 231.81, 316.1, 316.7, 207, 65, 73, 229.26

[56] References Cited

U.S. PATENT DOCUMENTS

| | | | |
|---|---|---|---|
| 1,858,656 | 5/1932 | Batherman . | |
| 1,861,151 | 5/1932 | Buschman . | |
| 1,895,656 | 1/1933 | Gadke . | |
| 2,782,296 | 2/1957 | Walter | 240/10 |
| 3,151,926 | 10/1964 | Schick et al. | 439/419 |
| 3,182,944 | 5/1965 | Laviano | 248/231.4 |
| 3,189,310 | 6/1965 | Trueson | 248/314 |
| 3,291,428 | 12/1966 | Sisulak | 248/618 |
| 3,716,818 | 2/1973 | Finkelstein | 439/419 |
| 3,861,632 | 1/1975 | Siilats | 248/224.3 |
| 4,491,902 | 1/1985 | Cangelosi | 362/389 |
| 5,228,774 | 7/1993 | Liao | 362/391 |
| 5,385,485 | 1/1995 | Fu | 439/419 |
| 5,389,008 | 2/1995 | Chung et al. | 439/419 |

FOREIGN PATENT DOCUMENTS 672562 10/1963 Canada .

*Primary Examiner*—Denise L. Gromada
*Assistant Examiner*—Thomas M. Sember
*Attorney, Agent, or Firm*—Buchanan Ingersoll; Lynn Alstadt

[57] ABSTRACT

A U-shaped mounting clip for a decorative light bulb socket of the type having a base with a channel extending transversely thereacross and an electrical wire placed therein has a generally U-shaped clip body having a first leg, a second leg, an arcuate member connecting the first leg and the second leg. The first leg is configured and sized to fit securely on the channel and to hold the electrical wire in place. Alternatively, the clip may be configured to have an L-shaped body. Either or both legs of the L-shaped body may be U-shaped.

10 Claims, 2 Drawing Sheets

MOUNTING CLIP FOR DECORATIVE LIGHTS

BACKGROUND OF THE INVENTION

1. Field of the Invention

This invention relates to mounting clips for attaching decorative lights, such as Christmas lights, to various structures, including roofing shingles and gutters. The mounting clip is intended for use with a light socket having an electrical-wire-carrying channel extending transversely through the light socket base.

2. Description of the Prior Art

The use of lights for decorating the exterior of a house is well known. Decorative lights typically consist of a large number of light sockets being wired together with light bulbs positioned in the light sockets. The "string" of lights can be mounted by retaining either the light socket or the wire. My mounting clip is concerned with a holder that retains the light socket.

Certain types of decorative lights have light sockets which have a channel extending transversely through the base, or bottom, of the socket. The channel may also be cruciform in shape having two portions, each of which lie transversely in the base and which are perpendicular to each other. The purpose of the channel is to permit the passage of electrical wire through the base while affording an electrical connection. In these types of lights, the electrical connection for each socket is made by two "stabs," or electrical contacts, which extend into the channel. Within the socket, the stabs are electrically connected with the light bulb. Two-conductor electrical wire is laid through the channel, and pressed against the stabs to make electrical contact. A bar is fitted securely on the channel to maintain the wire in place.

Typically, the decorative light sockets are molded of a resilient plastic material and have an integrally-molded, side-oriented mounting clip. Such a mounting clip is so positioned to permit the molder to use a simple, and less expensive, two-piece mold. To integrally mold a mounting clip into the base of the light socket would require a far more sophisticated, and expensive, three or four piece mold. Consequently, the art has considered it impractical to mold a light socket with a mounting clip on the bottom.

One object of these mounting clips is to display the lights so that they can easily be seen. The clips must not be adversely affected by cold temperatures, and should be able to hold the lights during high winds which commonly accompany winter storms.

A variety of separate mounting clips for decorative lights are available. Some prior art light mountings attach lights permanently to a structure. By permanently attaching the mountings to a house frame, gutter, or other surface, the surface is marred permanently. Because decorative lighting is seasonal, the lights are usually removed after the holidays at which time the marred surface is exposed.

One type of conventional, permanent light mounting is a two-piece rigid configuration comprising a base portion and a light socket retainer. The base portion is in the form of a L-shaped configuration. One leg of the L-shaped base portion is permanently mounted to a relatively flat surface of a house such as a window frame. The other leg of the L-shape is a channel member having flanges on opposite sides which accommodate the light socket retainer. The light socket retainer slides into the channel member. The light socket retainer has two resilient clamp members which grasp a light. This type of light mounting is described in U.S. Pat. No. 3,540,687.

Another prior art devices provides an L-shaped light support bracket with one of the legs being fitted under a shingle. The other leg includes a hole sized to receive a light bulb. This type of light support bracket can also be positioned within a retaining strip which is permanently attached to a flat building surface. Examples of these lighting mounts are shown in U.S. Pat. Nos. 4,905,131; 4,901,212; and 4,851,977. This type of mounting is easy to dislodge and frequently will come loose during winter storms.

Other related art devices concern mounting electric lights on Christmas trees. One such device comprises a spring-biased H-shaped club having a cylindrical light socket attached to the top of the clip. Multiple clips are connected together by insulated electrical wire. A light bulb is placed in each of the light sockets and the string of electrical wire is positioned on a Christmas tree wherein each clip attaches a light to a branch of the Christmas tree. Another device for mounting light bulbs to Christmas trees provides a resilient clamp which grips the light bulb, and spring fingers extending perpendicularly from the resilient clamp which grasps a tree limb.

Examples of light mountings for attaching lights to Christmas tree branches are illustrated in U.S. Pat. Nos. 2,782,296 and 1,895,656. This type of mounting is relatively expensive and difficult to make. The separate mounting clips usually will not remain attached to the lights during handling and storage. Many of them will also come loose from the light or the house or gutter during high winds which are common during winter.

My mounting clip is concerned with retaining the light socket by fitting securely on this channel in the light socket base. Because my clip is not integrally-molded into the light socket base, its shape is not limited by the constraints imposed on the light bulb socket molding process. In addition, my clip is configured and sized to securely fit on the channel, thereby affirmatively entrapping the electrical conductors and impaling them upon the stabs, thus providing a satisfactory electrical connection.

There is a need for an inexpensive non-permanent mounting clip for retaining outdoor decorative lights which will securely retain the lights when subjected to winter storms and remain on the lights during storage and handling.

SUMMARY OF THE INVENTION

A mounting clip for a decorative light bulb socket of the type having a base with a channel extending transversely thereacross and an electrical wire placed therein has a generally U-shaped clip body having a first leg, a second leg, and an arcuate member connecting the first leg and the second leg. The first leg is configured and sized to fit securely on the channel and to hold the electrical wire in place. Alternatively, the clip may be configured to have an L-shaped body. Either or both legs of the L-shaped body may be U-shaped.

The mounting clip may have at least one flared portion which is distal to the arcuate member or junction of the legs. In addition, it may be preferred that the second leg may flex relative to the first leg so that an article may be gripped therebetween. It may be further preferred to provide at least one transverse rib on the flared portion of the clip to augment the grip of the clip on the object to be decorated.

DETAILED DESCRIPTION OF THE PREFERRED EMBODIMENTS

Figure 1:
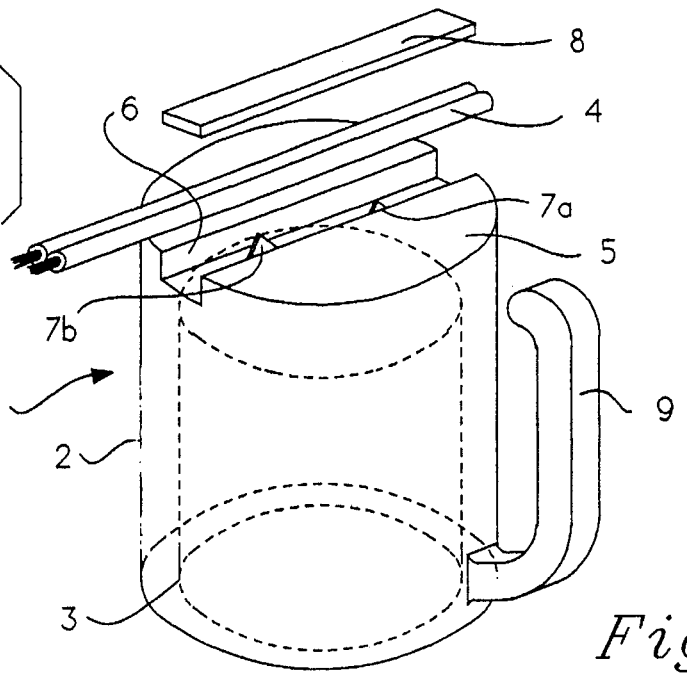
Fig.1. (Prior Art)
FIG. 1 is a perspective view of an inverted light bulb socket with integral mounting clip which is in the prior art.

FIG. 1 depicts a decorative light socket 1 of the type to which the mounting clips according to the invention herein apply. Light socket 1 includes light socket body 2 which has base 5. The decorative light socket 1 is inverted to better illustrate structures associated with base 5. Socket body 2 is formed to create a light bulb cavity 3 into which the decorative light bulb is inserted.

Channel 6 is formed to extend transversely through base 5 to permit the passage of electrical wire 4 through base 5 to provide an electrical connection to a light bulb (not shown) in socket 3. The channel may also be cruciform in shape having two portions, each of which lie transversely in the base and which are perpendicular to each other. Electrical contact is made by two stabs *7a, 7b* which extend into channel 6. Two-conductor electrical wire 4 is laid through channel 6 in contact with stabs *7a, 7b*. Bar 8 is press-fit on channel 6 to securely retain the electrical wire 4 within channel 6. Bar 8 is preferably made with a harder plastic than socket body 2. Bar 8 is pressed into channel 6 such that wire 4 is urged against, and penetrated by, the stabs *7a, 7b*. In this way, the intended electrical connection is made.

Alternatively, channel 6 may reside in a cap (not shown) which may snap, or be otherwise fitted, onto base 5. A cap could also cover a channel 6 formed in the base 5.

Light socket 1 typically is also provided with an integrally-molded, side-oriented mounting clip 9. Mounting clip 9 is affixed to socket body 2 at one end may be flexibly separated from body 2 at an opposite end, typically near base 5, to permit light socket 1 to be removably attached to an object which is to be decorated.

Figure 2:
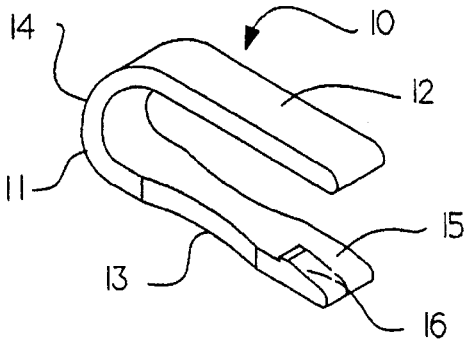
FIG. 2 is a perspective view of a first presently preferred embodiment of a mounting clip of the invention presented herein.

In FIG. 2, a first presently preferred embodiment of mounting clip 10 has a generally U-shaped clip body 11. Clip body 11 has a first leg 12, and second leg 13, with arcuate member 14 joining first leg 12 and second leg 13. First leg 12 is configured and sized to fit securely on the light bulb socket channel, and to hold the electrical wire in place. It is preferred to provide at least one flared portion 15, which could be on one or both of first leg 12 and second leg 13. Flared portion 15 is generally distal to arcuate member 14, and faces leg 12, 13 to which flared portion 15 is not attached. In addition, it is preferred that second leg 13 may flex relative to first leg 12 so that an article, such as an interior gutter lip or a shingle, may be gripped therebetween. It is further preferred that flared portion 15 have at least one transverse rib 16 attached thereto to augment the grip of clip 10 on the object to be decorated. Second leg 13 is shown as being the same length as first leg 12. However, first leg 12 could be shorter or longer than second leg 13, depending on the distance necessary for mounting clip 10 to slide under and engage an article such as, for example, a shingle or an interior gutter lip, in order to engage a secure connection.

Figure 3:
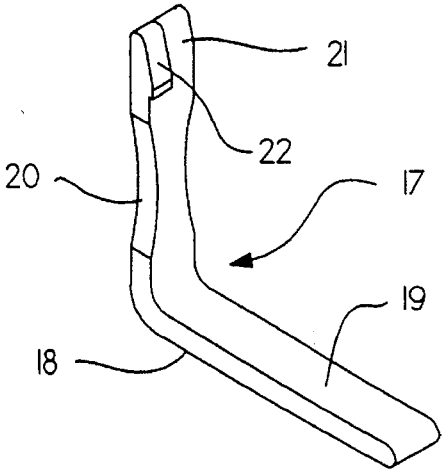
FIG. 3 is a perspective view of a second presently preferred embodiment of a mounting clip of the invention presented herein.

FIG. 3 illustrates a second presently preferred embodiment of the invention herein. Mounting clip 17 has a generally L-shaped clip body 18 having a first leg 19, and second leg 20 connected with first leg 19. First leg 19 is configured and sized to fit securely on the channel of a light socket body and to hold the electrical wire in place. Second leg 20 is preferred to have at least one flared portion 21, with flared portion 21 being distal to first leg 19. It is preferred that second leg 20 may flex relative to first leg 19 so that an article, such as an interior gutter lip or a shingle, may be gripped therebetween. It is further preferred that flared portion 21 have at least one transverse rib 22 attached thereto to augment the grip of clip 17 on the object to be decorated.

Figure 4:
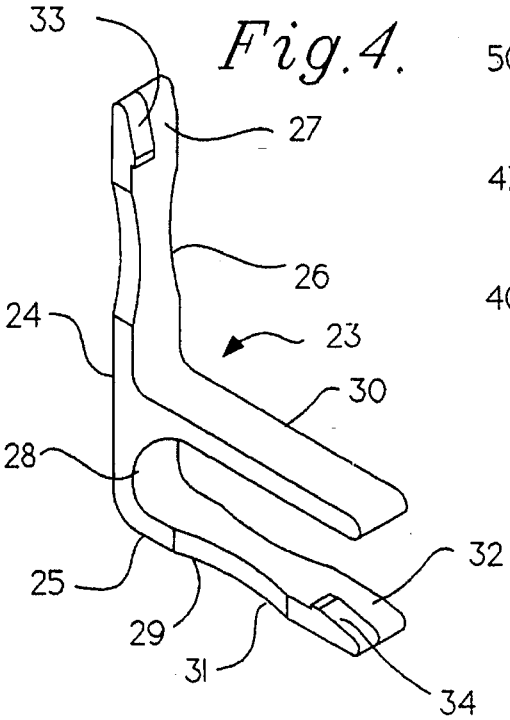
FIG. 4 is a perspective view of a third presently preferred embodiment of a mounting clip of the invention presented herein.

FIG. 4 illustrates mounting clip 23 which is a third presently preferred embodiment according to the invention herein. Mounting clip 23 has a generally L-shaped clip body 24 which has two conjoined legs, first leg 25 and second leg 26. First leg 25 has a generally U-shaped leg body 29 that includes first finger 30, second finger 31, and arcuate member 32, which connects first finger 30 and second finger 31. First finger 30 is configured and sized to fit securely on the channel of the light bulb socket and to hold the electrical wire in place. Arcuate member 28 is generally proximate to second leg 26.

It is preferred that at least one of first finger 30, second finger 31, and second leg 26, have at least one flared portion 27, 32, with flared portion 27, 32 being generally distal to arcuate member 28. Flared portion 27 may generally face the first finger 30, which flared portion 27, 32 is not attached. It is presently preferred that second leg 26 may flex relative to first leg 25. It is also preferred that second finger 31 may flex relative to first finger 30. It is also presently preferred that at least one of flared portion 27, 32 have at least one transverse rib 33, 34 attached thereto to augment the grip of clip 23 on the object to be decorated.

Figure 5:
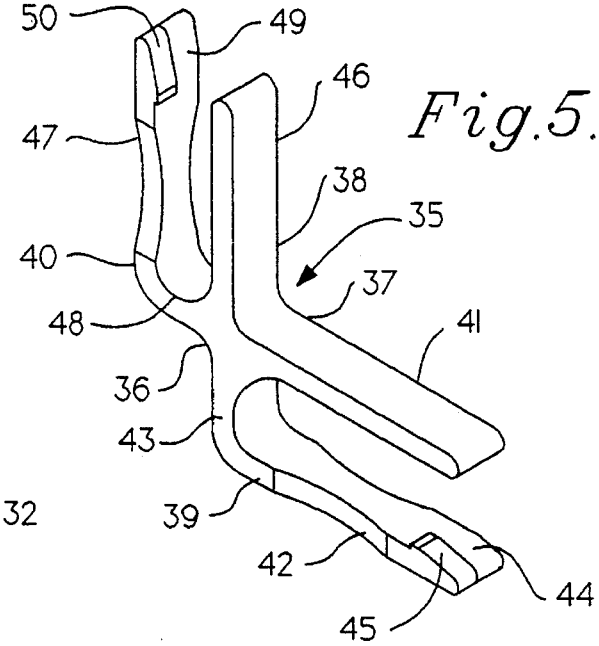
FIG. 5 is a perspective view of a fourth presently preferred embodiment of a mounting clip of the invention presented herein.

The mounting clip 35 shown in FIG. 5 is a fourth presently preferred embodiment of the invention herein. Mounting clip body 36 is generally L-shaped, having first leg 37 and second leg 38. First leg 37 and second leg 38 each have a generally U-shaped leg body 39, 40, respectively. First leg body 39 includes first finger 41, second finger 42, and arcuate member 43, which connects first finger 41 and second finger 42. First finger 41 is configured and sized to fit securely on the light socket body channel and to hold the electrical wire in place. In general, first arcuate member 43 is proximate to second leg 38. Second leg body 40 includes a third finger 46, a fourth finger 47, and second arcuate member 48 which connects third finger 46 and fourth finger 47. Third finger 46 is configured and sized to fit securely on the light socket channel and to hold the electrical wire in place.

In general, second arcuate member 43 is proximate to first leg 37. It is preferred to provide at least one flared portion 44, 49, on at least one of first finger 41, second finger 42, third finger 46 and fourth finger 47. It is preferred that the flared portion 44, 49 be distal to respective arcuate member 43, 48, respectively, and face the respective opposing finger 41, 46, to which flared portion 44, 49 is not attached. It is also preferred that first finger 41 may flex relative to second finger 42; and that third finger 46 may flex relative to fourth finger 47. It is further preferred that at least one of flared portion 44, 49 have at least one transverse rib 45, 50 attached thereto to augment the grip of clip 35 on the object to be decorated.

The clips shown in FIGS. 2 through 5 are sized to replace bar 8 in the light socket shown in FIG. 1. If the light socket has a cap arrangement, the clip may replace or fit within the cap. As shown in FIGS. 6, 7, 8, and 9, legs 12, 19, 30, and fingers 41 and 46, of clips 10, 17, 23, and 35, respectively, are configured and sized to fit securely on channel 6 which transversely crosses the base 5 of light bulb socket 1, and also hold electrical wire 4 in place. The clips may be oriented so that the light bulb socket is mounted generally horizontally or vertically.

Figure 6:
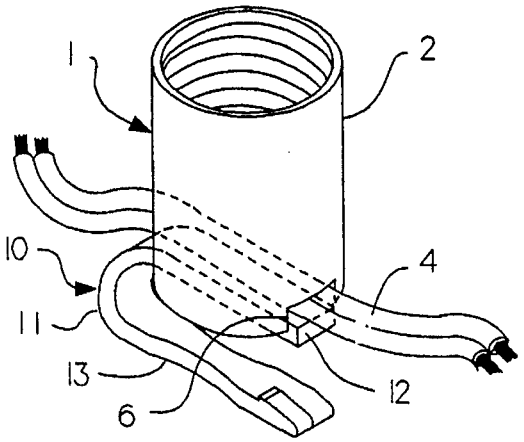
FIG. 6 is a perspective view of the presently preferred embodiment of a mounting clip shown in FIG. 2 attached to a decorative light bulb socket.

In FIG. 6, the presently preferred embodiment of mounting clip 10 shown in FIG. 2 is depicted as attached to a decorative light socket 1 similar to that shown in FIG. 1. In this presently preferred embodiment, as in FIG. 2, mounting clip 10 has clip body 11 which includes first leg 12 and second leg 13. First leg 12 is configured and sized to fit securely on channel 6 and to hold electrical wire 4 in place. In addition, second leg 13 is held at least partially beside and in approximation to socket body 2. Second leg 13 can be at least partially offset from the longitudinal axis of channel 6 to facilitate the passage of electrical wire 4 therethrough.

In the embodiment of FIGS. 2 and 6, the second leg 13 is shown as being the same length as first leg 12, respectively. However, first leg 12 could be shorter or longer than second leg 13 depending on the distance necessary for mounting clip 10 to slide under and engage an article such as, for example, a shingle or an interior gutter lip, in order to engage a secure connection.

Figure 7:
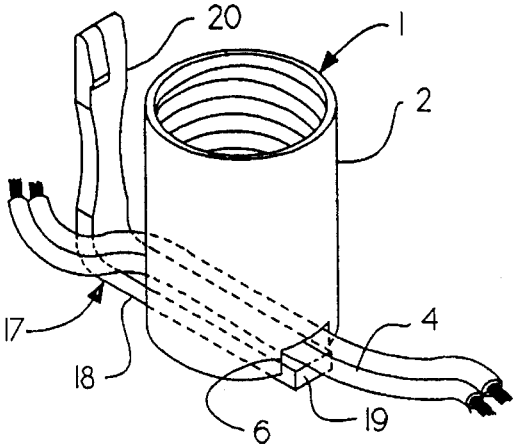
FIG. 7 is a perspective view of the presently preferred embodiment of a mounting clip shown in FIG. 3 attached to a decorative light bulb socket.

In FIG. 7, the presently preferred embodiment of mounting clip 17 shown in FIG. 3 is depicted as attached to a decorative light socket 1 similar to that shown in FIG. 1. In this presently preferred embodiment, clip body 18 which includes first leg 19 and second leg 20. First leg 19 is configured and sized to fit securely on channel 6 and to hold electrical wire 4 in place. In addition, second leg 20 is held at least partially beside and in approximation to socket body 2. Second leg 20 can be at least partially offset from the longitudinal axis of channel 6 to facilitate the passage of the electrical wire 4 therethrough.

Figure 8:
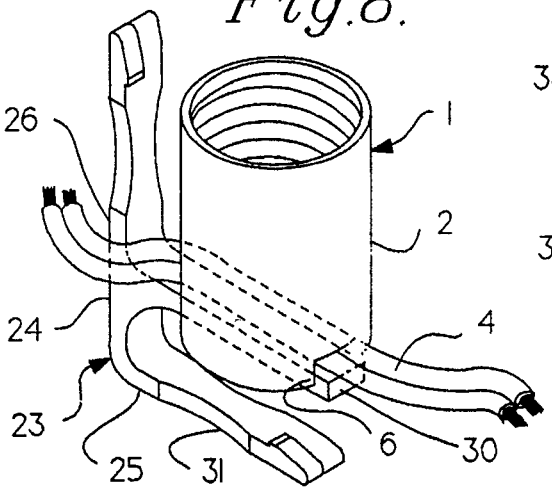
FIG. 8 is a perspective view of the presently preferred embodiment of a mounting clip shown in FIG. 4 attached to a decorative light bulb socket.

In FIG. 8, the presently preferred embodiment of mounting clip 23 in FIG. 4 is depicted attached to a decorative light socket 1 similar to that shown in FIG. 1. As in FIG. 4, clip body 24 includes first leg 25 and second leg 26. First leg 25 has first finger 30 and second finger 31. First finger 30 is configured and sized to fit securely on channel 6 and to hold electrical wire 4 in place. In addition, second leg 26 can be at least partially offset from the longitudinal axis of channel 6 to facilitate the passage of electrical wire 4 therethrough. Second leg 26 is held at least partially beside and in approximation to socket body 2.

Figure 9:
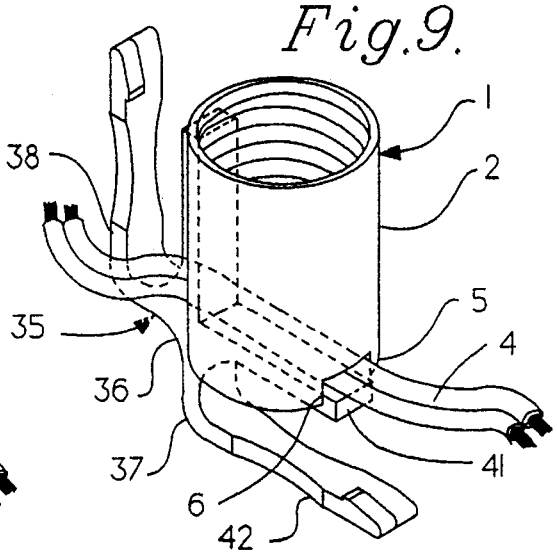
FIG. 9 is a perspective view of the presently preferred embodiment of a mounting clip shown in FIG. 5 attached to a decorative light bulb socket.

In FIG. 9, the presently preferred embodiment of mounting clip 35 shown in FIG. 5 attached to a decorative light socket 1 similar to that shown in FIG. 1. As in FIG. 5, clip body 36 has first leg 37 and second leg 38, which respectively include first finger 41 and second finger 42, and third finger 46 and fourth finger 47. Both first finger 41 and third finger 46 may be configured and sized to fit securely on channel 6 at base 5 of socket body 2. In this way, either finger 41 or 46 may be connected with base 5 to provide the desired support for socket body 2.

In the case where finger 41 is fitted within channel 6, second leg 38 can be held at least partially beside and in approximation to socket body 2. Where finger 46 is fitted within channel 6, first leg 37 can be held at least partially beside and in approximation to socket body 2.

Figure 10:
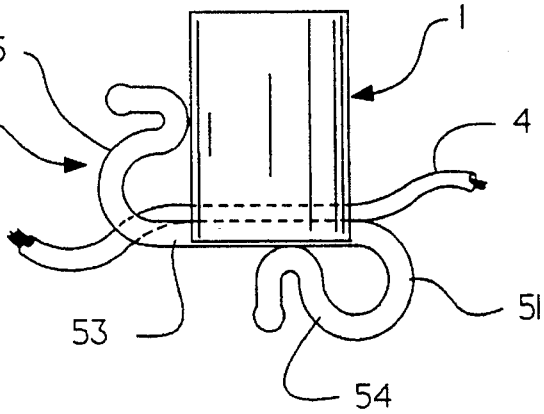
FIG. 10 is an elevational view of a fifth presently preferred embodiment of a mounting clip of the invention attached to a decorative light bulb socket.

As shown in FIG. 10 the mounting clip 52 may be configured so that the arcuate portion 51 causes a portion of the leg near the distal end of second leg 54 to abut or be closely adjacent to the first leg 53. Similarly upright leg 55 is curved to abut a socket 1 mounted on the first leg 53.

The mounting clips described herein can be sold separately for the customer to retrofit his exiting light sockets of the type shown in FIG. 1. One could also sell the clips already assembled into such sockets.

Although my mounting clip may be made of a harder plastic such as, for example, "LEXAN" plastic, I prefer to make the mounting clip of a softer plastic such as, for example, polypropylene. Indeed, I have found that a polypropylene clip is more difficult to dislodge from a gutter than the same clip made of "LEXAN" plastic. However, a variety of other plastics or metals could also be used. My mounting clip is suitable for attachment to gutters and roofing shingles in addition to any object having a planar portion, over which the clip can be fitted.

Although I have illustrated and described presently preferred embodiments of my mounting clip, and an improved decorative light bulb socket therewith, it should be distinctly understood that my invention is not limited thereto, but may be variously embodied within the scope of the following claims.

I claim:

1. A molded plastic mounting clip for a decorative light bulb socket of the type having a base with a channel extending transversely thereacross and an electrical wire placed therein, the mounting clip comprising a generally L-shaped clip body having a first leg, a second leg connected with the first leg, the first leg having a generally U-shaped leg body with a first finger, a second finger, an arcuate member connecting the first finger and the second finger and having a continuously curved surface extending from the first finger to the second finger, the first finger being configured and sized to fit securely on the channel and to hold the electrical wire in place, and the arcuate member being proximate to the second leg wherein the first finger is spaced apart from and parallel to the second finger along their respective lengths to permit a gutter lip to fit therebetween.

2. The mounting clip of claim 1 wherein at least one of the first finger, second finger, and second leg have at least one flared portion, the at least one flared portion being distal to the arcuate member, and facing the respective at least one of the first finger, second finger, and second leg to which the flared portion is not attached.

3. The mounting clip of claim 2 also comprising at least one transverse rib attached to the at least one flared portion.

4. The mounting clip of claim 1 wherein the second leg may flex relative to the first leg.

5. The mounting clip of claim 1 wherein the second finger may flex relative to the first finger.

6. A molded plastic mounting clip for a decorative light bulb socket of the type having a base with a channel extending transversely thereacross and an electrical wire placed therein, the mounting clip comprising a generally L-shaped clip body having a first leg, a second leg connected with the first leg, the first leg having a generally U-shaped leg body with a first finger, a second finger, and a first arcuate member connecting the first finger and the second finger, the first finger being configured and sized to fit securely on the channel and to hold the electrical wire in place, the first arcuate member being proximate to the second leg, the second leg having a generally U-shaped leg body with a third finger, a fourth finger, and a second arcuate member connecting the third finger and the fourth finger and having a continuously curved surface extending from the third finger to the fourth finger, the third finger being configured and sized to fit securely on the channel and to hold the electrical wire in place, and the second arcuate member being proximate to the first leg wherein the third finger and the fourth finger are spaced apart along of their respective lengths to permit a gutter lip to fit therebetween.

7. The mounting clip of claim 6 also comprising at least one flared portion attached to at least one of the first finger, the second finger, the third finger, and the fourth finger, the at least one flared portion being distal to the respective arcuate member, and facing the respective at least one of the first finger, the second finger, the third finger, and the fourth finger to which the flared portion is not attached.

8. The mounting clip of claim 7 also comprising at least one transverse rib attached to the at least one flared portion.

9. The mounting clip of claim 7 wherein the first finger may flex relative to the second finger.

10. The mounting clip of claim 6 wherein the third finger may flex relative to the fourth finger.

* * * * *